United States Patent [19]

Hand

[11] 3,958,807

[45] May 25, 1976

[54] SLOTTED-INSERT EXTRACTION PUZZLE

[76] Inventor: James F. Hand, 328 N. 6th, Douglas, Wyo. 82633

[22] Filed: July 11, 1975

[21] Appl. No.: 595,122

Related U.S. Application Data

[63] Continuation-in-part of Ser. No. 517,594, Nov. 21, 1974, abandoned.

[52] U.S. Cl. ..... 273/159

[51] Int. Cl.[2] ..... A63F 9/08

[58] Field of Search ..... 273/156, 158, 159

[56] References Cited

UNITED STATES PATENTS

| | | | |
|---|---|---|---|
| 2,921,793 | 1/1960 | Hedrick | 273/159 |
| 3,387,847 | 6/1968 | Boomhower | 273/159 |

*Primary Examiner*—Anton O. Oechsle
*Attorney, Agent, or Firm*—Clarence A. O'Brien; Harvey B. Jacobson

[57] ABSTRACT

A first base piece including a pair of spaced outwardly projecting abutments having free outer end portions with generally aligned openings formed therethrough is provided as well as a second elongated piece having one end portion thereof removably projectable through the abutment openings and including a longitudinal slot or third opening therein through which the outer end portions of the abutments are removably receivable upon displacement of the slotted portion of the second piece over the outer end portions of the abutments. An elongated flexible member is also provided having a pair of enlargements anchored to its opposite end portions and the enlargements are of a size and shape to be prevented from passage through the openings and to allow their passage through the slot. The flexible member passes through one of the openings with the pair of enlargements disposed on opposite sides of that opening and a third enlargement is slidably mounted on the flexible member between the first mentioned pair of enlargements. The third enlargement is of a size and shape preventing its passage through the slot and the openings when the one end portion of the second piece is projecting through the openings, but is of a size and shape to be received through the openings when the second piece has been withdrawn from the openings, although the third enlargement could be of a size to pass through either opening when the one end portion of the second piece is extending through both openings.

11 Claims, 6 Drawing Figures

SLOTTED-INSERT EXTRACTION PUZZLE

CROSS REFERENCE TO RELATED APPLICATION

This application comprises a continuation-in-part of my co-pending U.S. application Ser. No. 517,594 filed Nov. 21, 1974, for Slotted-Insert Extraction puzzle, now abandoned.

BACKGROUND OF THE INVENTION

Various forms of puzzles involving the provision of slotted and apertured components for utilization in connection with elongated flexible cord members having abutments anchored to the opposite end portions have been heretofore provided. Examples of previously known puzzles of this type are disclosed in U.S. Pat. Nos. 2,921,793 and 3,387,847.

However, such previously known puzzles, while being difficult to solve, are constructed in a manner whereby persons able to mentally carry out a series of procedural steps tend to be able to solve such puzzles with relative ease. Accordingly, persons capable of mentally carrying out a series of manipulative steps do not find they are sufficiently challenged by puzzles of the aforementioned type.

BRIEF DESCRIPTION OF THE INVENTION

The puzzle of the instant invention is of relatively simple construction, but includes structural features which entail sequential following of approximately 12 manipulative steps in order to solve the puzzle, even though all parts of the puzzle are readily viewable at all times. Accordingly, a considerable challenge is afforded even those persons capable of mentally carrying out various series of manipulative steps.

The main object of this invention is to provide a puzzle construction wherein all parts of the puzzle are visible at all times and a series of approximately 12 steps is required to solve the puzzle either by its disassembly from an assembled condition or by its assembly from a disassembled condition.

Another object of this invention, in accordance with the immediately preceding object, is to provide a puzzle construction which, even after having been properly disassembled, offers considerable challenge in the further solving of the puzzle by proper assembly thereof.

Yet another object is to provide a puzzle having few simple parts and which includes a maximum of two fully separated parts at any point of solving the puzzle, either during assembly or disassembly of the puzzle.

A final object of this invention to be specifically enumerated herein is to provide a puzzle construction in accordance with the preceding objects and which will conform to conventional forms of manufacture and be of simple and dimensionally interdependent construction so as to provide a device that will be economically feasible and long lasting as well as capable of being constructed in various forms relating to numerous interest subjects.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
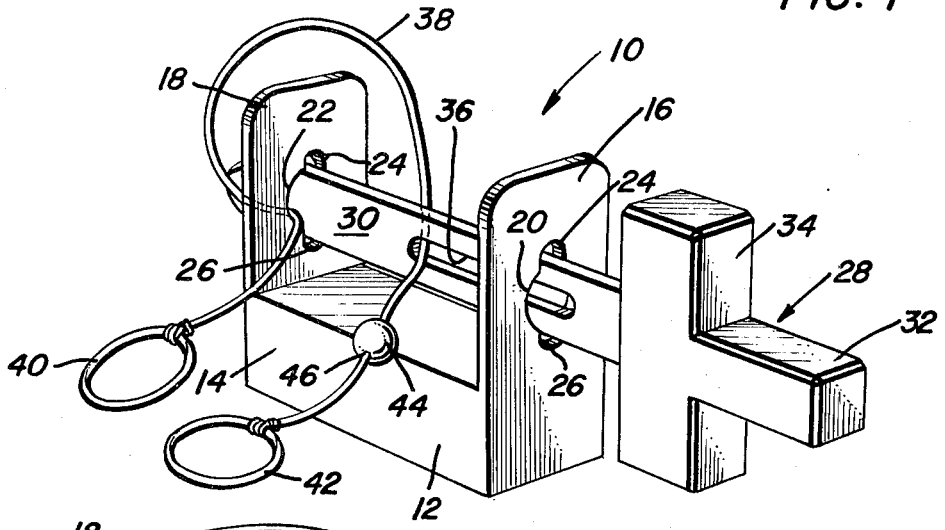
FIG. 1 is a perspective view of the puzzle construction in a fully assembled condition.

Referring now more specifically to the drawings the numeral 10 generally designates a single embodiment (of many different design variations) of the puzzle. The puzzle 10 includes a first base piece 12 comprising a generally rectangular solid base member 14 including a pair of opposite end upstanding abutment flanges 16 and 18 formed integrally with the base member 14. The abutment flanges 16 and 18 have aligned generally circular openings 20 and 22 formed therein above the lower ends of the flanges 16 and 18 and each of the openings 20 and 22 includes downwardly and upwardly opening upper and lower recesses 24 and 26 formed in the corresponding abutment flange and opening inwardly of the upper and lower peripheral portions of the circular opening. The recesses 24 and 26 opening into each circular opening define, together with the central vertical portion of the corresponding circular opening, a vertical slot through the corresponding abutment flange.

The puzzle 10 additionally includes a second elongated piece referred to in general by the reference numer 28 and the piece 28 is in the form of a dagger including a narrow elongated first end portion 30 defining the blade end of the dagger, a second end portion 32 defining a hand grip or handle and an intermediate transverse portion or abutment member 34 defining a transverse hand guard for the dagger 28.

The blade portion 30 is of a length to extend completely through the openings 20 and it will be noted that the upper and lower marginal edges of the blade portion 30 are received in the recesses 24 and 26. Further, the blade portion 30 includes a longitudinal slot or opening 36, the length of the slot 36 being less than the distance between the abutment flanges 16 and 18. Further, an elongated flexible member in the form of a string 38 (a lightweight chain may be used in lieu of the string) is provided and the string 38 is passed through the opening 22 formed in the abutment flange 18. The opposite ends of the string 38 have a pair of enlargements in the form of ring members or enlargements 40 and 42 secured thereto and the ring members 40 and 42 are of a size and shape preventing their passage through either of the openings 20 and 22 but which allows their passage through the slot 36. The ring members 40 and 42 are of an inside dimension to receive the blade portion 30 therethrough as a deceptive factor, but the blade portion 30 is not passed through or into either ring member as a portion of the correct solution of the puzzle 10.

Finally, a third enlargement 44 in the form of a spherical body having a diametric bore 46 formed therethrough is slidably mounted (although it may be fixed in position) on the string 38 between the enlargements or rings 40 and 42, the enlargement 44 being of a size and shape to be received through both of the openings 20 and 22 when the blade portion 30 is withdrawn therefrom. Further, as will hereinafter become apparent, the openings 20 and 22 are spaced sufficiently above the base member 14 whereby to enable the enlargement 44 to be passed through either opening above the blade portion 30 when the blade portion 30 is slipped downwardly over the corresponding abutment flange.

Figure 2:
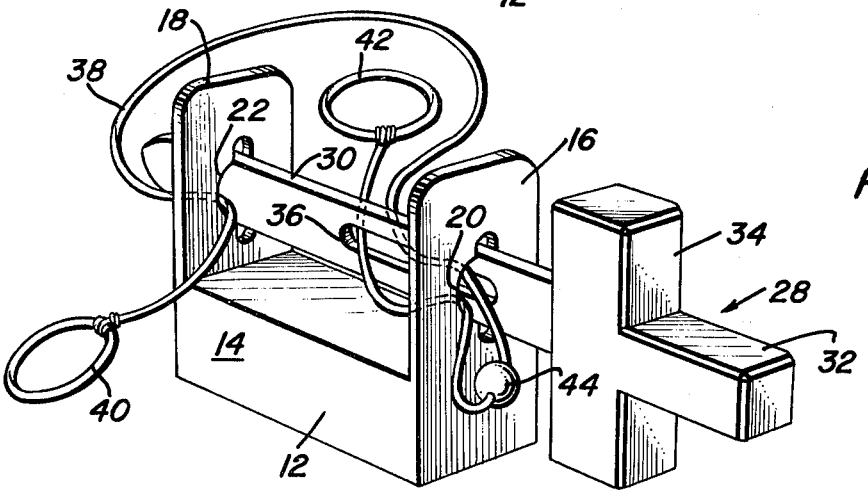
FIG. 2 is a perspective view of the puzzle construction with its parts in position after having completed the fourth step in solving the puzzle to its disassembled condition.
Figure 3:
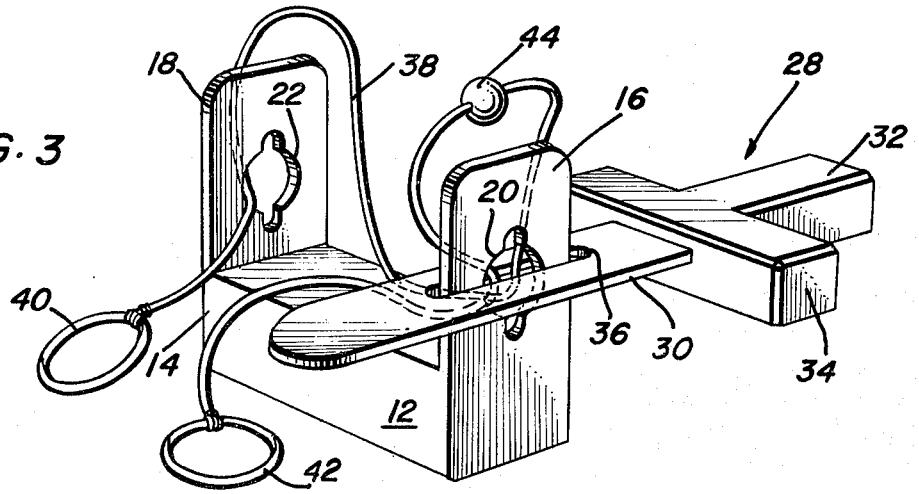
FIG. 3 is a perspective view of the puzzle construction with the components thereof in their relative positions after the seventh step in solving the puzzle to its disassembly.
Figure 4:
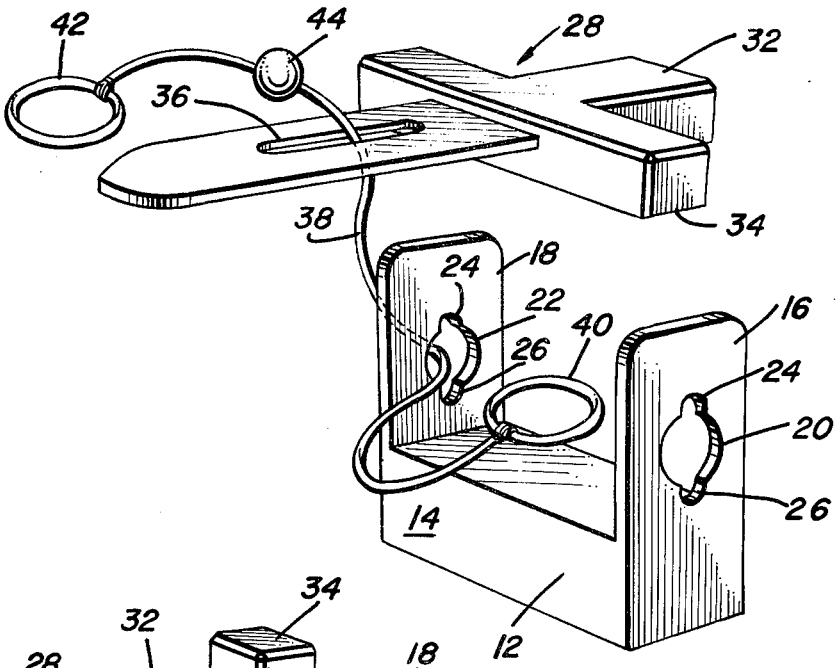
FIG. 4 is a perspective view of the puzzle construction with its component parts in position after the ninth step in the disassembly of the puzzle.
Figure 5:
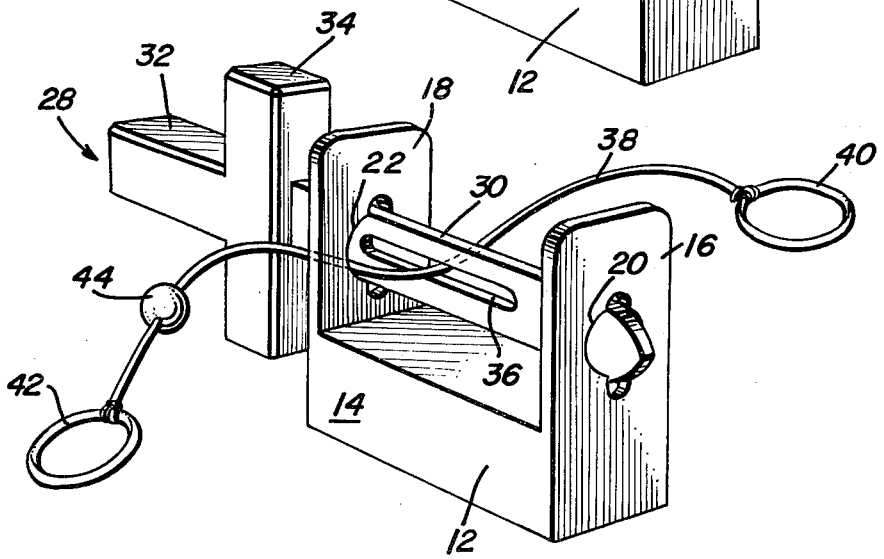
FIG. 5 is a perspective view of the puzzle construction after the tenth step in its disassembly.
Figure 6:
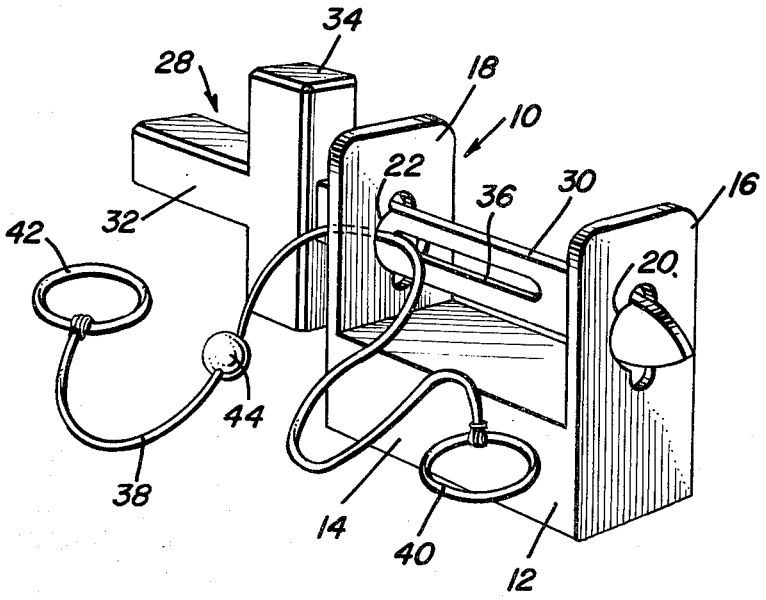
FIG. 6 is a perspective view of the puzzle with its component parts arranged in position after the eleventh step in the disassembly of the puzzle.

With attention now invited more specifically to FIGS. 1 and 2 of the drawings, the single embodiment of the puzzle 10 shown is fully assembled when the components thereof are positioned as illustrated in FIG. 1. In order to disassemble the puzzle 10 the following steps are carried out:

1. the second piece 28 is withdrawn to the right as viewed in FIG. 1 from the openings 22 and 20 in a manner to pull that portion of the string 38 passing through the slot 36 through the opening 20;

2. the third enlargement 44 is then passed through the opening 20 from the inner side thereof;

3. the second piece 28 has its slotted blade portion inserted back through the opeining 20, or at least sufficiently through the opening 20 to enable the enlargement 42 to be passed through the slot 36;

4. the enlargement 42 is passed through the slot 36 wherein the various components of the puzzle 10 will be relatively positioned as shown in FIG. 2 of the drawings;

5. the second piece 28 is again withdrawn from the opening 20;

6. the slotted blade portion 30 is thereafter downwardly displaced over the abutment flange 16 with the latter received upwardly through the slot 36, the portion of the string or flexible member 38 supporting the enlargement 44 and passing through slot 36 being located on the side of the abutment 16 remote from abutment 18;

7. the third enlargement 44 is then passed inwardly through the opening 20 wherein the puzzle components will be relatively positioned as illustrated in FIG. 3;

8. the blade portion 30 of the second piece 28 is upwardly displaced from engagement with and to a position above the abutment flange 16 whereupon both the second piece 28 and string 38 as well as the rings or enlargements 40 and 42 and the enlargement 44 supported therefrom are completely disengaged from the abutment flange 16;

9. the enlargement 42 is then passed through the slot 36 so as to be on the same side of the slotted blade portion 30 as the enlargement 44 whereupon the various components of the puzzle 10 will be arranged relative to each other in the manner illustrated in FIG. 4;

10. the second piece 28 has its slotted blade portion 30 inserted through the opening 22 from the outer side of the opening 22 in order to position the components of the puzzle 10 relative to each other in the manner illustrated in FIG. 5;

11. the enlargement 40 is thereafter passed through the slot 36 to completely disengage the string 38, the enlargements 40 and 42 and the enlargement 44 from the second piece 28 with the components of the puzzle 10 positioned relative to each other as illustrated in FIG. 6; and 12. the second piece 28 has its blade portion 30 withdrawn from the opening 22, resulting in full disassembly of the puzzle 10 with the second piece 28 fully separated from the base piece 12 as well as the flexible member 38.

In reassembling the puzzle 10 the following steps are carried out:

1. the blade portion 30 of the second piece 28 is inserted inwardly through the openings 20 and 22 from the outer side of the opening 22 whereupon the components of puzzle 10 will be arranged relative to each other in the manner illustrated in FIG. 6;

2. the enlargement 40 is passed through the slot 36 whereupon the component parts will be assembled relative to each other in the manner illustrated in FIG. 5;

3. the blade portion 30 of the second piece 28 is withdrawn from the opening 22 whereupon the component parts of the puzzle will be relatively positioned in the manner illustrated in FIG. 4;

4. the enlargement 42 is inserted downwardly through the slot 36 so that enlargement 42 is located on the side of the slotted blade portion 30 opposite to the location of enlargement 44;

5. the blade portion 30 of the second piece 28 is placed over and upon abutment flange 16 with the face of slotted blade portion 30 upon which the enlargement 42 is located being closest to the base member 14 and with the portion of the string (flexible member) 38 supporting enlargement 44 between abutments 16 and 18, after which the slotted blade portion is downwardly displaced to receive the abutment 16 upwardly through slot or opening 36 so that the components of the puzzle 10 are relatively positioned as illustrated in FIG. 3;

6. the enlargement 44 is inserted through the opening 20 from the inner side of abutment 16 to the other side of abutment 16 (i.e. from between the abutments 16 and 18 to the opposite side of abutment 16 from abutment 18);

7. the blade portion 30 of the piece 28 is upwardly withdrawn from engagement with the abutment flange 16 and the loop of string (flexible member) 38 which passes through slot or opening 36 and through enlargement 44 will now also pass through opening 20 in abutment 16;

8. the blade portion 30 of the second piece 28 is inserted through the opening 20 from the outside of the opening 20, but enlargement 44 is not admitted or passed through opening 20 and remains on the side of abutment 16 opposite from abutment 18, whereby the components will then be relatively positioned as illustrated in FIG. 2;

9. the enlargement 42 is inserted through the slot 36 from the side of the slotted portion 30 opposite to the location of enlargement 44 to the side of slotted portion 30 on which enlargement 44 is located.

10. the blade portion 30 of the second piece 28 is then withdrawn from the opening 20 to the side of abutment 16 opposite from abutment 18;

11. the third enlargement 44 is then displaced inwardly through the opening 20 from the side opposite from abutment 18 to the side between abutments 16 and 18; and 12. the blade portion 30 of the second piece 28 is inserted through the opening 20 and thence between abutments 16 and 18 toward or through opening 22, after which the components of the puzzle 10 will be back in their original positions illustrated in FIG. 1.

The structure of the puzzle 10 is such that it may be constructed of various readily available materials and it may therefore be mass produced at a low cost. The puzzle 10 has a deceptively simple appearance and contains few parts. Further, the puzzle has all of its parts interengaged at all times, except when the puzzle is fully disassembled and therefore the chances of one of the components of the puzzle being lost are very remote.

In addition, the puzzle can be "worked" without benefit of a support surface. The user's manipulative interest in the puzzle can be sporadic without losing its intrigue and without the need to return to the same beginning point each time "working" the puzzle is resumed. When fully disassembled the puzzle consists of two separate components which are not easily lost, broken or misplaced and the puzzle is such that many interesting and challenging design and procedural variations are possible while preserving its advantages above set forth. Furthermore, the solution process is sufficiently difficult to intrigue and amuse all ages, yet sufficiently simple to reward those who manipulate or "work" the puzzle with either a surprise or a calculated success.

The abutment member 34 is provide to prevent the slotted portion or blade 30 from passing completely through the openings 20 and 22 and the member 38 is of a length to enable the puzzle 10 to be "worked" without difficulty as a result of the member 38 being too short, but the member is sufficiently short to prevent the slotted portion 30 from being inserted through opening 22 immediately subsequent to above step (1) in the disassembly of the puzzle, which prevented step represents the second step of a more difficult disassembly (not shown) of the puzzle 10.

It is also pointed out that the openings 20 and 22 may be of any shape allowed by the cross sectional shape of the slotted portion 30 (the recesses 24 and 26 may be omitted if the basic shape of the openings 20 and 22 is sufficient to receive the slotted portion and to receive the enlargement 44 therethrough). Further, the puzzle 10 can also be made more difficult by one end portion of the string 38 being passed through the opposite end ring.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A puzzle comprising a first base piece including a pair of spaced outwardly projecting abutments having free outer end portions provided with generally aligned first and second openings formed therethrough, a second elongated piece having one end portion thereof removably projected through said openings and including a third opening formed therein through which said outer end portions of said abutments are removably receivable upon displacement of the slotted portion of said second piece over said outer end portions, an elongated flexible member having a pair of first and second enlargements anchored to its opposite end portions, said enlargements each being of a size and shape to prevent their passage through said first and second openings and to allow its passage through said third opening, said flexible member passing through one of said first and second openings with said pair of enlargements disposed on opposite sides of said one opening, a third enlargement mounted on said flexible member between said pair of enlargements, said third enlargement being of a size and shape preventing its passage through said third opening, but allowing it to be received through said first and second openings, the other end portion of said second piece including abutment means of a size and shape preventing its passage through either of said first and second openings.

2. The combination of claim 1 wherein each of said pair of enlargements comprises a ring member.

3. The combination of claim 1 wherein said third enlargement is slidably mounted on said flexible member between said pair of enlargements.

4. The combination of claim 3 wherein said third abutment comprises a generally spherical member.

5. The combination of claim 4 wherein each of said pair of enlargements comprises a ring member.

6. The combination of claim 1 wherein said one end portion of said second piece is in the shape of the blade portion of a dagger, the other end portion of said second peice being in the shape of a handle for said dagger, and said abutment means on said second piece other end portion being in the form of a transverse guard portion for the handle of said dagger, said third opening comprising a longitudinal slot formed in said blade portion with the ends of said slot generally equally spaced from the opposite ends of said blade portion and the length of said blade portion being greater than the spacing between the remote ends of said openings.

7. The combination of claim 6 wherein each of said pair of enlargements comprises a ring member.

8. The combination of claim 7 wherein said third enlargement is of a size and shape to be received through said first and second openings only when said second piece has said one end portion withdrawn from said openings, said third abutment comprising a generally spherical member slidably mounted on said flexible member.

9. The combination of claim 1 wherein said third enlargement is of a size and shape preventing its passage through either of said first and second openings when said second piece has said one end portion received through said first and second openings.

10. The combination of claim 1 wherein each of said pair of enlargements comprises a ring member, each of said ring members being of an inside dimension to lengthwise receive said one end portion of said second piece therethrough.

11. A puzzle including first and second abutments having first and second openings formed therethrough, an elongated piece having one end portion thereof removably projectable through said openings and including a third opening formed therein through which the portions of said abutments having said first and second openings formed therein are removably receivable, an elongated flexible member having a pair of first and second enlargements anchored to its opposite end portions, said enlargements each being of a size and shape to prevent their passage through said first and second openings and to allow its passage through said third opening, said flexible member passing through one of said first and second openings with said pair of enlargements disposed on opposite sides of said one opening, a third enlargement mounted on said flexible member between said first and second enlargements, said third enlargement being of a size and shape preventing its passage through said third opening, but allowing it to be received through said first and second openings, the other end portion of said second piece including abutment means of a size and shape preventing its passage through either of said first and second openings.

* * * * *